United States Patent [19]

Uzaki et al.

[11] Patent Number: 4,633,928

[45] Date of Patent: Jan. 6, 1987

[54] APPARATUS FOR MAKING CORE FROM GREEN SAND

[75] Inventors: Nagato Uzaki, Toyohashi; Shigeru Itoh, Aichi; Ryoji Kanayama; Hisashi Harada, both of Toyokawa; Yasutaro Kawamura, Okazaki, all of Japan

[73] Assignee: Sintokogio Ltd., Nagoya, Japan

[21] Appl. No.: 550,336

[22] Filed: Nov. 9, 1983

[30] Foreign Application Priority Data

Dec. 3, 1982 [JP] Japan ..... 57-213092

[51] Int. Cl.[4] ..... B22D 15/00

[52] U.S. Cl. ..... 164/19; 164/37

[58] Field of Search ..... 164/200, 201, 202, 37, 164/19, 20, 169, 186, 234, 228

[56] References Cited

U.S. PATENT DOCUMENTS

| | | | |
|---|---|---|---|
| 2,656,575 | 3/1950 | Herbruggen | 164/201 |
| 3,516,475 | 11/1966 | Dougherty | 164/37 |
| 3,989,090 | 11/1976 | Kawai | 164/228 |

FOREIGN PATENT DOCUMENTS

| | | | |
|---|---|---|---|
| 1263992 | 3/1968 | Fed. Rep. of Germany | 164/37 |
| 57-195555 | 12/1982 | Japan . | |
| 715710 | 9/1954 | United Kingdom | 164/234 |

*Primary Examiner*—Nicholas P. Godici
*Assistant Examiner*—G. M. Reid
*Attorney, Agent, or Firm*—Armstrong, Nikaido, Marmelstein & Kubovcik

[57] ABSTRACT

An apparatus and method for making cores from green sand continuously and automatically. The method comprises blowing the green sand together with compressed air into a die cavity formed by a pair of dies, stabbing the green sand filled in the die cavity by stabbing rods to compact the green sand thereby to form a core, and applying a surface stabilizing agent to the surface of the core taken out from the dies, followed by drying of the core. Disclosed also is an apparatus suitable for carrying out this method.

8 Claims, 1 Drawing Figure

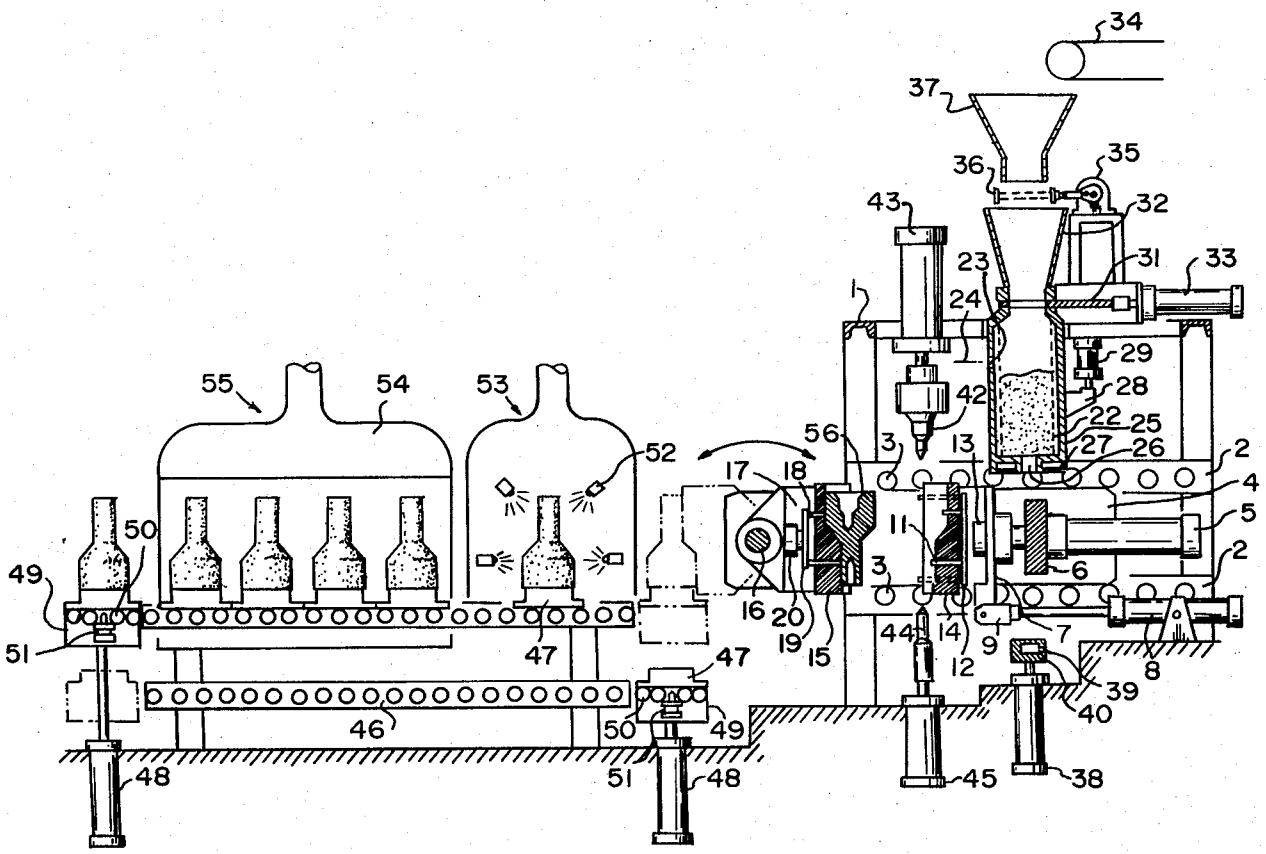
34
35
32
33
31
29
28
22
25
26
27
2
4
5
2
8
39
40
38
37
36
23
24
42
13
6
7
9
12
14
45
43
1
3
11
3
44
56
18
20
19
15
17
16
47
49
48
52
50
51
53
47
54
46
55
50
48
49
51

APPARATUS FOR MAKING CORE FROM GREEN SAND

BACKGROUND OF THE INVENTION

The present invention relates to a method of and apparatus for automatically making a core from green sand. Studies and developments have been made for making cores from green sand in one-by-one fashion but no method nor apparatus have been developed yet for automatically and continuously making cores from green sand.

SUMMARY OF THE INVENTION

Accordingly, an object of the invention is to provide a method of and apparatus for making cores from green sand automatically and continuously.

To this end, according to one aspect of the invention, there is provided a method of making a core from green sand comprising the steps of: sieving the green sand by means of a sieve; blowing the sieved green sand by means of compressed air into a die cavity defined in a die means through an opening formed in the die means; stabbing the green sand filled in the die cavity with a stabbing rod having a conically pointed end and inserted into the die cavity through the opening; taking out the formed core from the die means; and applying a surface stabilizing agent to the core taken out of the die means and then drying the core.

According to another aspect of the invention, there is provided a core making apparatus for making cores from green sand, the apparatus comprising: a vertically split type die means having a first die and a second die movable horizontally relatively to the first die, the first die and the second die being adapted to form, when they are jointed to each other, a die cavity which is communicated with the exterior through an upper end opening and a lower end opening formed in the die means; a blow head movable relatively to the vertically split type die means and adapted to blow the green sand into the die cavity through the upper opening; a sieve for sieving the green sand and supplying the sieved green sand into the blow head; a vent plate movable relatively to the vertically split type die means to selectively close the lower end opening in such a manner as to permit only air to be passed therethrough; a stabbing rod movable relatively to the vertically split type die means and adapted to be inserted into the die cavity through the upper opening to stab the green sand filled in the die cavity when the blow head is spaced from the upper opening of the vertically split type die means; a conveyor line adapted to recirculate stools, for receiving and supporting the cores shifted from the second die; a spraying station disposed along the conveyor line and adapted to apply a surface stabilizing agent to the cores received and held by the stools; and a drying station disposed at the downstream side of the spraying station as viewed in the direction of running of the conveyor line.

The above and other objects, features and advantages of the invention will become clear from the following description of the preferred embodiments taken in conjunction with the accompanying drawings.

BRIEF DESCRIPTION OF THE DRAWINGS

The attached sole FIGURE is a partial diagrammatic and partial sectional front elevational view of a core making apparatus embodying the present invention.

DESCRIPTION OF THE PREFERRED EMBODIMENTS

The invention will be described in detail hereinunder with reference to the attached sole FIGURE.

A core making machine for making a core from green sand is shown at the right half part of the FIGURE. The core making machine has a framework 1 situated on a bed. Pairs of transfer frames 2 and 2 are mounted on a lower portion of the framework 1. More specifically, upper transfer frames 2, opposing to each other in the direction perpendicular to the plane of the drawing sheet, are positioned above two transfer frames 2 constituting the lower pair. Flanged rollers 3,3 are attached to the surfaces of the transfer frames 2,2 opposing in the direction perpendicular to the drawing sheet. A movable frame 4 constituted by a pair of rectangular plates opposing to each other in the direction perpendicular to the drawing sheet is held between the flanged rollers 3,3 of the upper and lower transfer frames 2,2. A cylinder 5 is disposed in the right portion of the space between two plates of the movable frame 4 and is connected to these plates through a mounting member 6 connected between these plates, such that its piston rod is projectable leftwardly. A stationary frame 7 is secured to the end of the piston rod. A cylinder 8 having a piston rod projectable leftwardly is mounted on the bed at the lower right corner of the transfer frames 2,2. The end of the piston rod of the cylinder 8 is connected through a connecting member 9 to the lower end of the stationary frame 7 to which the piston rod of the cylinder 5 is connected. The arrangement is such that, as the cylinder 8 extends or retracts its piston rod while the piston rod of the cylinder 5 is fixed, the stationary frame 7 is moved to the left and right. On the other hand, as the cylinder 5 operates to extend and retract its piston rod with the piston rod of the cylinder 8 fixed, only the movable frame 4 is moved to the left and right while the stationary frame 7 is fixed.

On the end of the stationary frame 7, mounted is a core push-out mechanism constituted by core push-out pins 11, push-out plate 12 and a spring means 13, as well as a vertical split type die means constituted by a stationary die (or a first die) 14 and a movable die (or a second die) 15. Some of the push-out pins 11 are projectable into the die cavity in the stationary die 14 by the force exerted by the spring means 13, while other pins 11 are projectable from the surface at which the stationary die 14 is jointed to the movable die 15.

A shaft 16 is connected between two plates of the frame 4 at a left portion of the latter. A rotary frame 17 carried by the shaft 16 is rotatable 180° by a device which is not shown. A core push-out mechanism constituted by push-out pins 18, push-out plate 19 and a cylinder 20 is mounted on the end of the rotary frame 17. The movable die 15 of the vertical split type die means also is mounted on the end of the rotary frame 17. The arrangement is such that the push-out pins 18 are projected into and retracted from the cavity in the movable die 15 as the cylinder 20 operates to extend and retract its piston rod. The stationary die 14 and the movable die 15 of the vertical split type die means are jointed to each other as the cylinder 8 operates to retract its piston rod while the piston rod of the cylinder 5 is extended. A blow head 25 is disposed above an upper end opening of the vertically split type die means when the dies are brought together. The blow head 25 is provided therein with a slit cylinder 22 and is communicated with a source of compressed air (not shown) through an aperture 23 formed in the wall thereof and a conduit 24.

A sand blowing hole 26 communicating with the interior of the blow head 25 and vent holes 27 communicating with the ambient air are formed in the bottom wall of the blow head 25. Furthermore, a connecting bracket 28 is fixed to the outer side wall of the blow head 25. The bracket 28 is connected also to the end of the piston rod of a cylinder 29 which is secured to an upper portion of the framework 1 to project downwardly therefrom. The blow head 25, therefore, is movable up and down in accordance with the extending and retracting operation of the cylinder 29. A chute 32 opposes to the upper end opening of the blow head 25 across a gate 31. The gate 31 is adapted to be moved to the left and right by means of a cylinder 33 which is mounted on the blow head 25 thereby to selectively close the upper end opening of the blow head 25. A chute 37 disposed above the chute 32 has an upper end opening positioned under the left end of a sand supplying device 34 and a lower end opening positioned above a rockable sieve 36 which is disposed above the chute 32 and adapted to be rocked by a motor 35 having an eccentric shaft.

A cylinder 38 is disposed on the bed to project upwardly therefrom at a position under the blow head 25. The cylinder 38 has a piston rod the end of which is connected to a vent plate 40 provided in its upper surface with vent holes 39 communicating with the atmosphere.

An upper stabbing rod 42, having a conically pointed lower end and having a diameter increasing in a stepped manner towards its upper side, is disposed at the left side of the blow head 25 at a suitable distance therefrom. The stabbing rod 42 is fixed to the end of the piston rod of a cylinder 43 fixed to an upper portion of the framework 1 to project downwardly therefrom. A lower stabbing rod 44 with a conically pointed upper end and having a suitable diameter and length is disposed beneath the upper stabbing rod 42. The lower stabbing rod 44 is fixed to the end of a piston rod of a cylinder 45 fixed to the bed to project upwardly therefrom.

The left half part of the FIGURE shows a line for applying an agent to the thus formed cores and for drying the cores. The line has a roller conveyor 46 situated on the bed and having an upper run constituting the forwarding section and a lower run constituting the returning section. A plurality of stools 47 are carried by the conveyor 46 so as to be transported by the latter. Lifters each having an upwardly directed cylinder 48 and a support 49 connected to the end of the piston rod of the cylinder 48 are disposed at both ends of the roller conveyor 46. The support 49 of each lifter is movable vertically between the forwarding level and the returning level of the roller conveyor 46 by the operation of the cylinder 48. The support 49 has rollers 50 for carrying the stool 47 and a cylinder 51 for fixing the stool 47 on these rollers 50.

A spray station 53, constituted by a plurality of spray devices 52 for spraying a stabilizing agent onto the surface of the core, is disposed at the right-side end of the forwarding section of the roller conveyor 46. A drying station 55, constituted by a drying device 54, is disposed at the left side of the spraying section 53. The drying device 54 is adapted to heat and dry the core by means of microwave or high-frequency induction heating, after the application of the stabilizing agent.

In operation, the cylinder 8 operates to retract its piston rod so as to drive the movable frame 4 to the right, thereby to position the stationary die 14 of the vertically split type die means under the blow head 25. At the same time, the cylinder 5 operates to extend its piston rod to further move the movable frame 4 to the right together with the movable die 15 of the die means fixed to the movable frame 4, thereby to joint the movable die 15 to the stationary die 14. In the meantime, the push-out pins 11 on the jointing surface of the stationary die 14 are pressed into the latter overcoming the force of the spring means 13 by the jointing surface of the movable die 15. The inward movement of the push-out pins 11 on the jointing surface is accompanied by the retracting movement of other push-out pins 11. Namely, other push-out pins 11 are retracted from the cavity in the stationary die 14.

Subsequently, the cylinder 29 operates to extend its piston rod to bring the lower surface of the blow head 25 into contact with the upper surface of the die, thereby to close the upper end opening of the die. Simultaneously, the cylinder 38 operates to extend its piston rod to bring the upper surface of the vent plate 40 into contact with the lower surface of the die, thereby to close the lower end opening of the die. Thereafter, the green sand is supplied by the sand supplying device 34 to the sieve 36 through the chute 37 so that lumps of green sand are broken into particles through the sieve 36 and the sand particles are made to fall into the blow head 25 through the chute 32. In this state, the gate 31 at the upper end of the blow head 25 is closed and compressed air is supplied from a source (not shown) into the slit cylinder 22 in the blow head 25 through the conduit 24 and the aperture 23. Consequently, the green sand is blown into the die cavity of the vertically split type die through the sand blowing hole 26 in the blow head 25. The compressed air blown together with the green sand into the die cavity is released to the atmosphere through the vent holes 27 and 39 in the blow head 25 and the vent plate 40. Compressed air residing in the blow head 25, if any, is suitably released to the atmosphere after the charging of the green sand.

After the completion of the blowing of the green sand, the cylinders 29 and 38 operate to retract their piston rods to move the blow head 25 and the vent plate 40 away from the die means. Then, the cylinder 8 operates to extend its piston rod to drive the movable frame 4 to the left, thereby to locate the die means at a position between the upper stabbing rod 42 and the lower stabbing rod 44. Then, the cylinders 43 and 45 are activated to project the upper stabbing rod 42 and the lower stabbing rod 44 into the die cavity through the upper end opening and the lower end opening of the die means, so that the green sand filled in the die cavity is compressed towards the walls of the die cavity to form a stiff hollow core 56.

After the formation of the core, the cylinders 43 and 45 are operated to retract their piston rods to withdraw the stabbing rods 42 and 44 upwardly and downwardly through the upper and lower end openings of the die means, respectively. At the same time, the cylinder 5 operates to retract its piston rod to drive the movable frame 4 to the left, thereby to separate the movable die 15 from the stationary die 14. Consequently, the push-out pins 11 are released from the pressing force exerted by the movable die 15 so that they project into the die cavity in the stationary die 14, as well as the jointing surface of the stationary die 14, by the resilient force of the spring means 13, so that the core 56 is parted from the stationary die 14 and is moved to the left while being held by the cavity in the movable die 15.

After the frame 4 has been moved to the left end of its stroke, the rotary frame 17 is rotated 180° counter-clockwise by the operation of the driving device (not shown). At the same time, the stool 47 is mounted on and fixed to the support 49 disposed at the right side end of the roller conveyor 46, and the cylinder 48 is activated to lift the support 49 to the forwarding level of the conveyor 46, so that the core 56 held by the movable die 15 is placed on the stool 47. Then, as the cylinder 20 operates to project the push-out pins 18 into the cavity of the movable die 15 so that the core 56 is parted from the movable die 15 and shifted to the stool 47. The core 56 is thus transferred to the spraying and drying line, and is conveyed together with the stool 47 by the roller conveyor 46 to the spraying station 53 where a surface stabilizing agent is applied to the core 56 by means of the spray devices 52. The core 56 is then conveyed by the roller conveyor 46 to the drying station 55 so as to be dried by the drying device 54. After the drying, the stool 47 carrying the dried core 56 is shifted to the support 49 disposed at the left-side end of the conveyor 46 and the core 56 is separated from the stool 47 as the completed core. Subsequently, the support 49 is lowered to the returning level of the roller conveyor 46 by the retracting operation of the cylinder 48, and the stool 47 on the support 49 is shifted to the returning section of the roller conveyor 46 so as to be conveyed to the right by the latter.

Meanwhile, in the core making machine, the push-out pins 18 are retracted after the transfer of the core 56, and the rotary frame 17 is rotated 180° in the clockwise direction, thus completing one cycle of operation. This operation is cyclically repeated to continuously and successively make cores.

It will be understood from the foregoing description that, according to the invention, cores are continuously and automatically made from green sand. The invention, therefore, offers the following advantages.

(1) The cost for making cores is reduced remarkably thanks to the use of less-expensive green sand in place of conventionally used sands such as shell sand, cold-box sand or the like which are generally expensive.

(2) The repeated use of the sand is facilitated because the core is made from the same sand, i.e. the green sand, as that used for making the main mold.

(3) The core made in accordance with the invention is hollow and, hence, exhibits a good collapsibility and permeation to gases.

(4) It is possible to obtain a compact arrangement for a series of operations including core making, application of surface stabilizing agent and drying.

Although the invention has been described through specific terms, it is to be noted here that the embodiment described hereinbefore is not exclusive and various changes and modifications may be imparted thereto. For instance, although the line for circulating stools 47 in the described embodiment operates in a vertical plane, this line may be substituted by a circulating line which operates in a horizontal plane. Other changes and modifications are still possible without departing from the scope of the invention which is limited solely by the appended claims.

What is claimed is:

1. A core making apparatus for making cores from green sand, said apparatus comprising:

a vertically split type die means having a first die and a second die movable horizontally relatively to said first die, said first die and said second die being adapted to form, when they are jointed to each other, a die cavity which is communicated with the exterior through an upper end opening and a lower end opening formed in said die means;

a frame movable horizontally, a first cylinder having a rod, either one of said cylinder and said rod being connected to said frame while the other is connected to said first die, and a second cylinder connected to said first die and adapted to move said frame horizontally, said second die being pivotally secured to said frame for 180° rotation;

a blow head movable relatively to said vertically split type die means and adapted to blow the green sand into said die cavity through said upper opening;

a sieve for sieving the green sand and supplying the sieved green sand into said blow head;

a vent plate movable relatively to said vertically split type die means to selectively close said lower end opening in such a manner as to permit air to be passed therethrough;

a stabbing rod movable relatively to said vertically split type die means and adapted to be inserted into said die cavity through said upper opening to stab the green sand filled in said die cavity when said blow head is spaced from said upper opening of said vertically split type die means;

a conveyor line adapted to recirculate stools for receiving and supporting the cores shifted from said second die;

a spraying station disposed along said conveyor line and adapted to apply a surface stabilizing agent to said cores received and held by said stools; and a drying station disposed at the downstream side of said spraying station as viewed in the direction of running of said conveyor line.

2. A core making apparatus according to claim 1 characterized by further comprising a lower stabbing rod movable relatively to said vertically split type die means and adapted to be inserted into said die cavity to stab the green sand filled in said die cavity when said lower end opening is opened by said vent plate.

3. A core making apparatus according to claim 2, wherein said vertically split type die means is movable in the horizontal direction, said blow head and said upper stabbing rod being disposed above said vertically movable die means while said vent plate and said lower stabbing rod are disposed under said vertically split type die means.

4. A core making apparatus according to claim 1, wherein said second die is rotatable over 180° so that said core held by said second die is placed on said stool by the 180° rotation of said second die.

5. A core making apparatus according to claim 1, wherein a chute is attached to the upper end of said blow head through a gate, while said sieve is disposed above said chute, said apparatus further comprising a sand supplying device disposed above said sieve.

6. A core making apparatus according to claim 1, wherein said blow head is movable up and down and is adapted to be lowered, when the horizontally movable vertically split type die means has been moved to the position under said blow head, thereby to blow the green sand into said die cavity through said upper end opening of said vertically split type die means.

7. A core making apparatus according to claim 1, wherein said blow head is provided at its bottom portion with a green sand blowing hole and a plurality of vent holes communicating with the ambient air, whereby the compressed air blown together with said green sand is released through said vent holes and said vent plate.

8. A core making apparatus according to claim 1, wherein said conveyor line is adapted to recirculate said stools in a vertical plane.

* * * * *